US008092614B2

(12) United States Patent
Doherty et al.

(10) Patent No.: US 8,092,614 B2
(45) Date of Patent: Jan. 10, 2012

(54) CONVEYOR DISHWASHER COMPRISING A PLURALITY OF FINAL-RINSE LIQUID SPRAY JETS AND METHOD OF USE THEREOF

(75) Inventors: James E. Doherty, Gurnee, IL (US); Alan Varacins, Burlington, WI (US); Charles E. Warner, Troy, OH (US); Harald Disch, Elzach (DE); Werner Neumaier, Offenburg (DE); Gerhard Frei, Ohlsbach (DE)

(73) Assignee: Premark FEG L.L.C., Wilmington, DE (US)

( * ) Notice: Subject to any disclaimer, the term of this patent is extended or adjusted under 35 U.S.C. 154(b) by 800 days.

(21) Appl. No.: 11/570,456

(22) PCT Filed: May 31, 2005

(86) PCT No.: PCT/US2005/018892

§ 371 (c)(1),
(2), (4) Date: Dec. 12, 2006

(87) PCT Pub. No.: WO2006/007233

PCT Pub. Date: Jan. 19, 2006

(65) Prior Publication Data

US 2007/0251547 A1 Nov. 1, 2007

(30) Foreign Application Priority Data

Jun. 22, 2004 (DE) ..... 10 2004 030 003

(51) Int. Cl.
*B08B 3/02* (2006.01)

(52) U.S. Cl. ..... 134/25.2; 134/18

(58) Field of Classification Search ..... 134/18, 134/25.2, 56 D, 57 D, 58 D
See application file for complete search history.

(56) References Cited

U.S. PATENT DOCUMENTS

| | | | | |
|---|---|---|---|---|
| 1,730,348 | A | | 10/1929 | Anstiss |
| 2,235,885 | A | | 3/1941 | Johnson |
| 2,270,595 | A | | 1/1942 | Lewis |
| 3,504,390 | A | | 4/1970 | Wing |
| 3,504,683 | A | | 4/1970 | Timmer et al. |
| 3,598,131 | A | | 8/1971 | Weihe, Jr. |
| 3,739,790 | A | | 6/1973 | Gudz et al. |
| 3,789,860 | A | | 2/1974 | Katterheinrich et al. |
| 3,900,040 | A | | 8/1975 | Graber et al. |
| 4,066,472 | A | | 1/1978 | Perry et al. |
| 4,070,204 | A | | 1/1978 | Hardy et al. |
| 4,170,240 | A | | 10/1979 | Gentry |
| 4,231,806 | A | | 11/1980 | Henry |
| 4,313,451 | A | | 2/1982 | Vilen |
| 4,509,543 | A | | 4/1985 | Livingston et al. |
| 4,532,983 | A | | 8/1985 | Bradshaw et al. |
| 4,561,904 | A | * | 12/1985 | Eberhardt, Jr. ..... 134/18 |
| 4,582,259 | A | | 4/1986 | Hoover et al. |
| 4,788,992 | A | | 12/1988 | Swainbank et al. |
| 4,872,466 | A | | 10/1989 | Noren |
| 5,497,798 | A | * | 3/1996 | Fritz et al. ..... 134/151 |
| 5,507,877 | A | | 4/1996 | Magsig et al. |
| 5,846,339 | A | | 12/1998 | Masshoff et al. |
| 5,879,471 | A | | 3/1999 | St. Martin |
| 6,354,481 | B1 | | 3/2002 | Rich et al. |
| 6,632,291 | B2 | | 10/2003 | Rabon et al. |
| 2002/0096192 | A1 | | 7/2002 | Reichold |

FOREIGN PATENT DOCUMENTS

| | | |
|---|---|---|
| DE | 1428349 | 11/1968 |
| DE | 1628813 | 7/1970 |
| DE | 2322216 | 9/1974 |
| DE | 116388 | 11/1975 |
| DE | 2607813 | 9/1977 |
| DE | 2712020 | 9/1978 |
| DE | 2736088 | 2/1979 |
| DE | 3419423 | 11/1984 |
| DE | 3441222 | 5/1986 |
| DE | 3707366 | 3/1987 |
| DE | 3922067 | 1/1991 |
| DE | 4437737 | 4/1996 |
| DE | 29622760 | 7/1997 |
| DE | 19644438 | 4/1998 |
| DE | 19704989 | 8/1998 |
| DE | 19829650 | 1/2000 |
| DE | 20220465 | 8/2003 |
| EP | 0022307 | 1/1981 |
| EP | 0678275 | 10/1995 |
| EP | 0980668 | 2/2000 |
| EP | 0980669 | 2/2000 |
| EP | 0980670 | 2/2000 |
| EP | 1042983 | 10/2000 |

(Continued)

OTHER PUBLICATIONS

Patent Abstracts of Japan, vol. 018, No. 634 (C-1281) (Dec. 2, 1994) & JP 06245890 (Yokokawa Denshi Kiki KK) (Sep. 6, 1994).

Patent Abstracts of Japan, vol. 017, No. 164 (M-1390) (Mar. 30, 1993) & JP 04327119 (Mitsubishi Heavy Ind. Ltd.) (Nov. 16, 1992).

International Search Report issued Nov. 7, 2005, regarding PCT/US2005/018892.

U.S. Appl. No. 11/569,986; Office Action Dated May 24, 2010 and copy of Claims rejected.

International Search Report mailed Dec. 7, 2005; PCT/US2005/018893.

The Compact Automatic Basket Transpor Machine; Group—On Closest Area High Performance and Economically; MEIKO Maschinenbau GmbH & Co; Nov. 1993; with Translation; 9 pages.

*Primary Examiner* — Michael Barr
*Assistant Examiner* — Saeed T Chaudhry
(74) *Attorney, Agent, or Firm* — Thompson Hine LLP

(57) ABSTRACT

Conveyor-type dish washer and method of operating it, wherein during a final-rinse operation at least from one side, preferably from each the two sides, of the items to be cleaned, at least two final-rinse liquid spray jets are sprayed in different directions in relation to each other, wherein at least one final-rinse liquid spray jet is inclined in the direction of the movement of a dish carrier and at least another final-rinse liquid spray jet is inclined against the direction of the movement of the dish carrier.

12 Claims, 10 Drawing Sheets

FOREIGN PATENT DOCUMENTS

| | | | |
|---|---|---|---|
| GB | 2243285 | | 10/1991 |
| JP | 04-327119 | | 11/1992 |
| JP | 05-269073 | | 10/1993 |
| JP | 08-056884 | | 3/1996 |
| JP | 08056884 | * | 3/1996 |
| JP | 09-248270 | | 9/1997 |
| JP | 11-056735 | | 3/1999 |
| JP | 2001-346747 | | 12/2001 |
| WO | 83/01187 | | 4/1983 |
| WO | 2004/018143 | | 3/2004 |

* cited by examiner

CONVEYOR DISHWASHER COMPRISING A PLURALITY OF FINAL-RINSE LIQUID SPRAY JETS AND METHOD OF USE THEREOF

TECHNICAL FIELD

The present application relates to a dishwasher operating method and to a conveyor-type dishwasher with at least one wash zone and a final-rinse zone.

BACKGROUND

Among the machines used as commercial dishwashers are front-loading machines, rack push-through machines and conveyor-type dishwashers, while under-counter dishwashers are generally used in the domestic sector. The loading of front-loading machines with dish racks in which the dishes are held and the removal of the dish racks from front-loading machines takes place from the front. In the case of rack push-through machine, the dish racks, laden with dirty dishes, are manually pushed into the machine from a feeding side and, after completion of the cleaning program, are manually removed from the machine from a delivery side. Conveyor-type dishwashers, which are distinguished in comparison with the previously mentioned types of dishwasher by a high throughput of items to be washed per unit of time, have at least one spray zone, but usually more than one spray zone, through which the items to be cleaned are automatically conveyed.

In each spray zone of a conveyor-type dishwasher, at least one spray operation can be executed. In the case of conveyor-type dishwashers, it is generally customary for the dishes to be cleaned of major soil in a first spray zone (pre-wash zone) by spraying with a dishwashing detergent solution, while thorough cleaning of the dishes takes place in a subsequent spray zone (wash zone) by renewed spraying with a dishwashing detergent solution. Thereafter follows at least one, mostly two spray zones (rinse zones) in which dishes are sprayed with a rinse aid solution, in order to finally rinse the dishes completely clear of dirt particles and clear of dishwashing detergent solution. The final-rinse operation is generally carried out at temperatures of 80° C. to 85° C., before the dishes are then conveyed into a drying zone for drying.

A conveyor-type dishwasher with four spray zones is described in U.S. Pat. No. 3,598,131. The spray zones are designed as a pre-wash zone, as a wash zone, as a rinse zone and as a final-rinse zone, the items to be cleaned being conveyed continuously through these spray zones one after another in suitable dish racks. The individual zones are separated from one another by suspended flexible "curtains". In the pre-wash zone, a solution at about 49° C. is sprayed onto the items to be cleaned by means of spray nozzles, in order to remove particles of food from the items to be cleaned. Subsequently, in the wash zone, a mixture of water and dishwashing detergent at about 66° C. and in turn, subsequently in the rinse zone, hot water at temperatures of about 77° C. is sprayed onto the items to be cleaned by means of spray nozzles. To achieve disinfection of the items to be cleaned, in the final-rinse operation, hot water at about 82° C. is sprayed onto the items to be cleaned by means of spray nozzles in the final-rinse zone.

A similar conveyor-type dishwasher, likewise with four spray zones, is known from U.S. Pat. No. 3,789,860. U.S. Pat. No. 3,789,860 describes a pre-wash zone, in which larger particles of food are removed, a subsequent main wash zone for accomplishing effective cleaning of the items to be cleaned, a main-rinse zone and, finally, a final-rinse zone. The temperature in the dishwasher is approximately 46° C. in the first zone and increases zone by zone up to a temperature of approximately 82° C. in the final-rinse zone.

The device of U.S. Pat. No. 4,231,806 is suitable for dishwashers with a number of spray zones and describes means for creating a barrier in the form of a fluid curtain, a fluid curtain preferably being created respectively at the entry and exit of a wash zone and at the entry and exit of a final-rinse zone. The fluid curtain at the entry and exit of the wash zone greatly reduces the escape of vapour from the wash zone.

In the medical sector, U.S. Pat. No. 6,632,291 discloses methods for the washing, rinsing and/or antimicrobial treatment of medical instruments, equipment, transporting carts and animal cages. Washing takes place at temperatures between 30° C. and 80° C., preferably between 35° C. and 40° C., while usually-rinse is carried out at temperatures between 40° C. and 80° C. and a final-rinse is carried out at increased temperatures at approximately 80° C. to 95° C. The antimicrobial treatment is performed with an antimicrobial agent. The method described can be carried out automatically in a wash apparatus which has a number of stations.

U.S. Pat. No. 4,788,992 describes an ultrasonic cleaning method and an apparatus for carrying out ultrasonic cleaning of elongated strip material. After the ultrasonic cleaning, the strip material is sent past dewatering blowers and subsequently past spray nozzles of a number of rinse chambers, before it is heated and dried in a final step.

U.S. Pat. No. 6,354,481 relates to the processing of electronic components and in particular to a compact apparatus for remelting and subsequently cleaning electronic components, in particular BGA components. The cleaning zone has a wash zone and a rinse zone, and a hot-air blower may also be arranged downstream of them, whereby temperatures in the wash zone are at 49° C. to 71° C. and in the rinse zone at 49° C. to 99° C.

U.S. Pat. No. 2,235,885 describes an apparatus for washing (cleaning) and disinfecting glassware, the apparatus having a chamber which can be tightly closed for the spray operation. Within the chamber, positioning carriers are provided for holding the glassware to be cleaned. Also arranged in the chamber, underneath the positioning carriers, are tubes with upwardly directed spraying means and, in the upper part of the chamber, there are tubes with downwardly directed openings, which are fed with hot water, cold water or steam through corresponding supply lines. The feeding in of hot water and steam into the pipework is manually set by means of a hot-water valve, and the feeding in of cold water into the pipework is manually set by means of a cold-water valve.

In the case of washing operation described in U.S. Pat. No. 2,235,885, glassware to be cleaned is first rinsed and disinfected with hot water and steam in the chamber. Subsequently, a cold-water valve is progressively opened and, after the cold-water valve has been opened, the hot-water valve is closed, so that then only cold water is introduced into the chamber and the glassware to be cleaned is chilled with cold water in the final-rinse operation.

In U.S. Pat. No. 4,070,204 a washing method is described which can be carried out in a dishwasher which includes a cleaning chamber into which cold water, hot water or a combination of both can be introduced optionally. The washing method begins with at least one cold pre-wash, which is followed by a hot wash. Subsequently, a cold-water rinse and at least one hot-water final-rinse are carried out.

The development of dishwashers and dishwashing methods, in particular in the commercial sector, is dominated today by the objective of energy and water conservation, which is becoming increasingly important for environmental reasons. Nevertheless, in particular in the case of commercial dishwashers, the throughput, which is the amount of items cleaned per unit of time, and the washing quality should not be deteriorated. The working conditions of the operator of a dishwasher are also considerably impaired in the region of the dishwasher by vapours which escape, with the result that an improvement in this area is also desirable.

Furthermore, apart from thorough cleaning, disinfection of the items to be cleaned should also be carried out. In the field of dishwasher technology, disinfection means killing micro-organisms at a level that is neither harmful to health nor impairs the quality of food. In the case of some wash methods, disinfection is achieved by the use of chemical disinfection components, but this has disadvantages from aspects concerning the environment and safety at work. Disinfection by adequately intense heating of the items to be cleaned is also known.

It would be desirable to provide an improved operating method and an improved conveyor-type dishwasher of the type as indicated which—while maintaining high cleaning quality—have in particular low energy and water consumption, are sufficiently productive and can be used without reservations from aspects concerning the environment and safety at work.

SUMMARY

A conveyor-type dishwasher and related methods may be provided with one or more features to assist in low energy and/or water consumption, including one or more of (i) executing final-rinse of items with a consumption of final-rinse liquid that is 3.5 l/min or less; (ii) executing final-rinse of items with a consumption of final-rinse liquid of 3 $l/m^2$ movement of the horizontal take-up plane of a dish carrier or less; (iii) executing final-rinse of items with one or more side-originating final-rinse liquid spray jets in combination with top-originating final-rinse liquid spray jets and bottom-originating final-rinse liquid spray jets; (iv) prior to a final rinsing step executing a cleaning operation or a subsequent hot post wash and/or a rinsing step using filtered and/or regenerated washing or rinsing solution that is produced from a used washing or rinsing solution in dependence on a contamination dependent or time dependent control signal; (v) subsequent to a final-rinse operation, passing items through a cold-water curtain; (vi) between a wash operation and a final-rinse operation, subjecting items to the action of steam; and (vii) after a wash operation, providing a hot post-wash operation using hot post-wash liquid that has a higher temperature than a final-rinse liquid.

DETAILED DESCRIPTION

Figure 1:
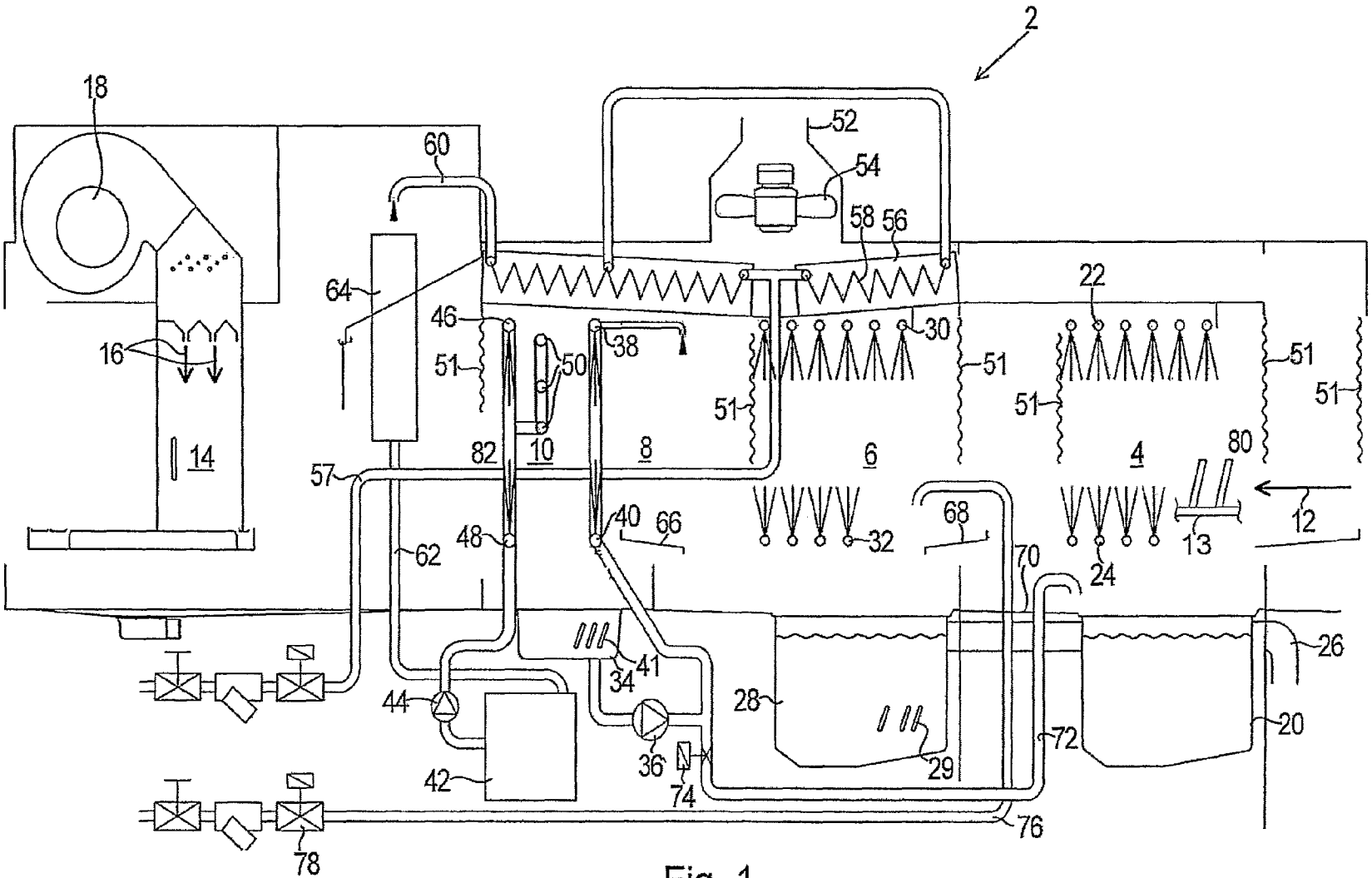
FIG. 1 is a schematic longitudinal sectional representation of a conveyor-type dishwasher according to a first embodiment of the invention.

One proposed method comprises at least one wash operation, that is to say spraying with a dishwashing detergent solution for thoroughly cleaning remains of food from the items to be cleaned, a so-called hot post-wash, and at least one final-rinse (German: Klarspülen), preferably with a rinse aid solution for rinsing off all dirt particles and dishwashing detergent solution from the items to be cleaned. Dishes, cutlery, forks, spoons, knifes and trays are regarded as items to be cleaned. Dishwashing detergent solution is water enriched with a dishwashing detergent, whereby the addition of the dishwashing detergent promotes thorough removal of remains of food from the items to be cleaned and counteracts renewed soiling of the items by the dishwashing detergent solution. The final-rinse aid solution is generally clean water mixed with a rinse aid, whereby the interfacial tension of the rinse aid solution is reduced by the rinse aid, to that optimum wetting of the cleaned items is achieved.

An important idea in this respect is that, in the case of conveyor-type dishwashers, high-temperature dishwashing operations, that is to say wash or rinse operations, are to be carried out in a central region of the machine, whereas low-temperature wash or rinse operations are to be carried out in the region of the entry or exit of the machine. This produces a temperature profile which drops from a maximum value in a central region towards the outer regions. By contrast, in the case of the previously known conveyor-type dishwashers, the temperature profile increases to the maximum value in the region of the exit, since disinfection of the items to be washed only takes place in the final-rinse operation (German: Klarspülen) at temperatures of 80° C. to 85° C. In the prior art, the preceding wash operations are carried out at temperatures around or below 70° C.

The novel temperatures profile has the effect of keeping energy losses low, since an escape of heat and vapour from the central region is suppressed by the two adjacent regions, and condensing of the vapour in the cooler outer regions is promoted. The heat of condensation can therefore still be used within the conveyor-type dishwasher.

Accordingly, hot post-wash may be performed with a high water temperature and after that, final rinsing (German: Klarspülen) may be performed with a lower water temperature. The high water temperature during the hot post-wash operation is preferably higher than 70° C., so that a disinfection of the items to be cleaned is achieved, and the lower water temperature during the final-rinse operation is preferably lower than 65° C. and more preferably lower than 60° C., so that condensing is promoted by the temperature reduction. The hot post-wash operation may be carried out according to choice as a wash operation, that is with a dishwashing detergent solution, or as a final-rinse operation, that is with a rinse aid solution.

Furthermore, the items to be cleaned may be subjected to a significantly greater amount of wash solution during the hot post-wash operation than during the subsequent final-rinse operation, with the result that in the hot post-wash step a high level of heat application to the dishes is also realized by means of a high overall thermal capacity of the solution to which they are subjected. In particular, a hot post-wash solution throughput in the range between 5 and 30 l/min, preferably between 10 and 20 l/min, is provided during the hot post-wash operation, while the consumption of final-rinse aid solution is intended to be significantly less than half of that (preferably 2 to 3 l/min).

Also in the case of dishwashers with only one cleaning chamber, the heat of condensation, which is released in particular during the final-rinse operation with a lower water temperature, can be used. Furthermore, the escape of steam when the dishwasher is opened is reduced by the preceding condensation, so that the method is also advantageous for such dishwashers.

The final-rinse operation may advantageously be carried out at a temperature of the rinse aid solution in the range between 25° C. and 65° C., preferably between 25° C. and 60° C. In this temperature range, the temperature reduction in comparison with the preceding hot post-wash operation may be great enough to promote condensation, but excessive cooling of the items to be washed may also be prevented. Excessive cooling of the dishes and wasting of clean water may also be avoided if the final-rinse operation is executed at least partly in a spray mist. Furthermore, the finely distributed droplets of the spray mist can promote condensation of the vapour. The escape of vapour from the conveyor-type dishwasher may be reduced by the items to be cleaned passing through a cold-water curtain, in particular in the form of a cold-water spray mist, following the final-rinse operation.

If the hot post-wash operation is performed directly before the final-rinse operation at a water temperature in the range between 80° C. and 90° C., in particular at 85° C., only short contact times are necessary to achieve adequate disinfection of the items to be cleaned, on account of the high temperature level. Preferably, a wash operation at a water temperature of 65° C. is carried out before the hot post-wash operation, in order to get an effective cleaning of the dishes with relatively short contact times.

At least one rinse operation can also be performed under steam. If the items to be cleaned are subjected to the action of steam between the hot post-wash operation and the final-rinse operation, the level of heat transfer into the items to be cleaned is increased, and accordingly disinfection of the items is assisted. The introduction of steam also has the advantageous effect that is keeps down the evaporation losses, in particular during the wash operation and the hot post-wash operation.

Filtered and/or regenerated final-rinse aid solution may be used for executing the hot post-wash and/or a wash operation. Using already used final-rinse aid solution also for the hot post-wash and/or for a wash operation successfully reduces the amount of clean water required. Filtering the final-rinse aid solution which was already used and/or regenerating it with clean water has the effect of keeping down the consumption of clean water while maintaining the cleanness of the dishwashing detergent solution or final-rinse aid solution, in particular whenever the filtering and/or regeneration is carried out in dependence on the turbidity of the solution. This can reduce or prevent re-soiling of the items to be cleaned.

A further feature is to reduce the water consumption for the final-rinse operation, in comparison with the prior art, by a differentiated nozzle arrangement. Whereas in the case of the nozzle arrangements previously used in the final-rinse operation, with only upper and lower nozzles, a relatively strong spray jet of the individual nozzles was required, since concealed surface areas of the items to be cleaned were only reached by deflected spray jets, an advantageous nozzle arrangement with greater differentiation of the spray directions allows a large part of the surface areas of the items to be cleaned to be reached directly. Therefore, the final-rinse operation can be carried out with reduced water throughput. In particular in combination with the hot post-wash operation described above, a low water throughput during the final-rinse operation at lower temperatures has the advantageous effect that cooling of the items to be cleaned during the final-rinse operation is minimized as much as possible. This may even allows drying with blower air of a lower temperature (<50° C.) to be carried out after the final-rinse operation, since the still elevated temperature of the items assists drying of them.

Specifically, the final-rinse operation may be executed with the items to be cleaned being subjected to the action of final-rinse aid solution from at least three sides of a final-rinse zone, to be precise from the floor and from the ceiling surface and from at least one side wall. A large part of the surface areas of the items to be cleaned is then reached directly. Advantageously, the nozzles may be arranged on the side wall/side walls in such a way that the feeding of the final-rinse aid solution from the side walls takes place in each case at four positions in the central height region of the final-rinse zone, two of which in particular are positioned respectively close to each other. The nozzles on the floor and on the ceiling surface may be arranged in such a way that the feeding of the final-rinse aid solution from the floor and from the ceiling surface proceeds from five points of the floor and four positions of the ceiling surface of the final-rinse zone, which are respectively arranged essentially equidistant from one another and from the side walls. In order to achieve reduced use of water during rinsing, the final-rinse operation may be executed in spray mist with a consumption of final-rinse aid solution of 3.5 l/min or less, in particular of 2 l/min-3 l/min for a rinse capacity of typically 2500-5000 plates per hour or a comparable throughput of other items to be cleaned.

With regard to the apparatus, a conveyor-type dishwasher, in particular a multi-tank conveyor-type dishwasher, comprising several spray zones; a conveying device for conveying items to be cleaned through the spray zones; water feeds assigned to the spray zones for feeding dishwashing detergent solution and final-rinse aid solution respectively and for subjecting the items to be cleaned to them; and also means assigned to at least some of the water feeds for setting the temperature of the respective wash or rinse solution.

The conveying device for conveying items to be cleaned may take different forms; it may be designed as a dish conveyor belt, chains, or latching bars. The means for temperature setting may be designed either as controllable heaters in a reservoir of the spray solution, or else they may be formed simply by the systems of tubes which lead to a reservoir of the rinse solution. The term spray solution refers both to dishwashing detergent solution and to a final-rinse aid solution.

A conveyor-type dishwasher according to one aspect is characterised in that means are provided for setting the water temperature in a hot rinse operation (hot post-wash operation) to a first temperature value, in particular more than 70° C., and for setting the water temperature of a subsequent final-rinse operation to a lower value, in particular less than 65° C. or preferably less than 60° C.

According to a further apparatus-related aspect, a conveyor-type dishwasher is characterised in that a final-rinse zone is provided which has final-rinse water nozzles on the floor and on the ceiling surface and additional final-rinse water nozzles on at least one side wall.

Referring now to FIG. 1, a conveyor-type dishwasher 2 according to the invention, which is designed for carrying out the operation method explained, is shown in a schematic longitudinal sectional representation. The conveyor-type dishwasher 2 represented has four spray zones 4, 6, 8, 10, which are arranged one downstream of the other along a conveying direction 12 of items to be cleaned (not represented) that may be carried by a carrier 13. Items to be washed are conveyed through the conveyor-type dishwasher 2 (from right to left in FIG. 1) and accordingly through the four spray zones 4, 6, 8, 10 arranged spatially one downstream of the other, and are made to undergo a spraying operation in the respective spray zone 4, 6, 8, 10.

In the conveying direction 12 of the items to be cleaned, the four spray zones 4, 6, 8, 10 are designed as a pre-wash zone 4 (pre-cleaning spray zone), a main wash zone 6 (main cleaning spray zone), a hot post-wash zone 8 (or hot cleaning spray zone, which may also be referred to in the art as an initial rinse zone) and a final-rinse zone 10 (German: Klarspülzone). In the drying zone 14, blower air 16 is sent by a blower 18 into the drying zone 14, whereby drying of items to be cleaned is achieved.

In the pre-wash zone 4, large remains of food are removed from the items to be cleaned by washing with dishwashing detergent solution. Dishwashing detergent solution is fed from a pre-wash reservoir 20 by means of a pump not shown and via corresponding lines to upper pre-wash nozzles 22 and lower pre-wash nozzles 24 (which may also be formed as simple openings in the lines). The upper pre-wash nozzles 22 are arranged in a downwardly directed manner in an upper part of the pre-wash zone 4 and the lower pre-wash nozzles 24 are arranged upwardly directed manner in the lower part of the pre-wash zone 4, so that dishwashing detergent solution is sprayed onto the items to be cleaned that are located in the pre-wash zone 4 from above and from below by the pre-wash nozzles 22, 24.

The pre-wash nozzles 22, 24 and further nozzles 30, 32, 38, 40, 46, 48 of the downstream spray zones 6, 8, 10 may be distributed or can be moved over the entire width, measured transversely to the conveying direction 12, of the respective spray zone 4, 6, 8, 10, so that over the entire width, over which items to be cleaned are conveyed through the conveyor-type dishwasher, the items to be cleaned can be sprayed with the corresponding liquid from the nozzles 22, 24, 30, 32, 38, 40, 46, 48. The nozzles may be fixed in place in the respective spray zone 4, 6, 8, 10, or else some or all of them may be attached to rotating or otherwise movable wash tubes. Furthermore, an overflow 26 may be provided at the pre-wash reservoir 20, allowing excess dishwashing detergent solution to be transferred from the pre-wash reservoir 20 into a waste-water line.

In the main wash zone 6, dishwashing detergent solution is fed by means of a pump not shown from a main wash reservoir 28 with an (optional) heating device 29 via corresponding lines to upper main wash nozzles 30 and to lower main wash nozzles 32. The upper main wash nozzles 30 are arranged in a downwardly directed manner in an upper part of the main wash zone 6 and the lower main wash nozzles 32 are arranged in an upwardly directed manner in a lower part of the main wash zone 6, so that dishwashing detergent solution is sprayed onto the items to be washed in the main wash zone 6 from above and from below by the main wash nozzles 30, 32.

For rinsing the items to be cleaned in the hot post-wash zone 8, in the embodiment shown, a final-rinse liquid or solution is fed from a heatable hot wash reservoir 34 by means of a pump 36 to upper hot post-wash nozzles 38 and to lower hot post-wash nozzles 40, by means of which spraying of the items to be cleaned takes place from above and from below in the hot post-wash zone 8. In the hot post-wash reservoir 34, which can be heated by means of a heating device 41, a high temperature of the hot solution may be set such that adequate disinfection of the items to be cleaned is achieved by heating the items to be cleaned in the hot spray operation by spraying the items to be cleaned with the hot solution.

Figure 6:
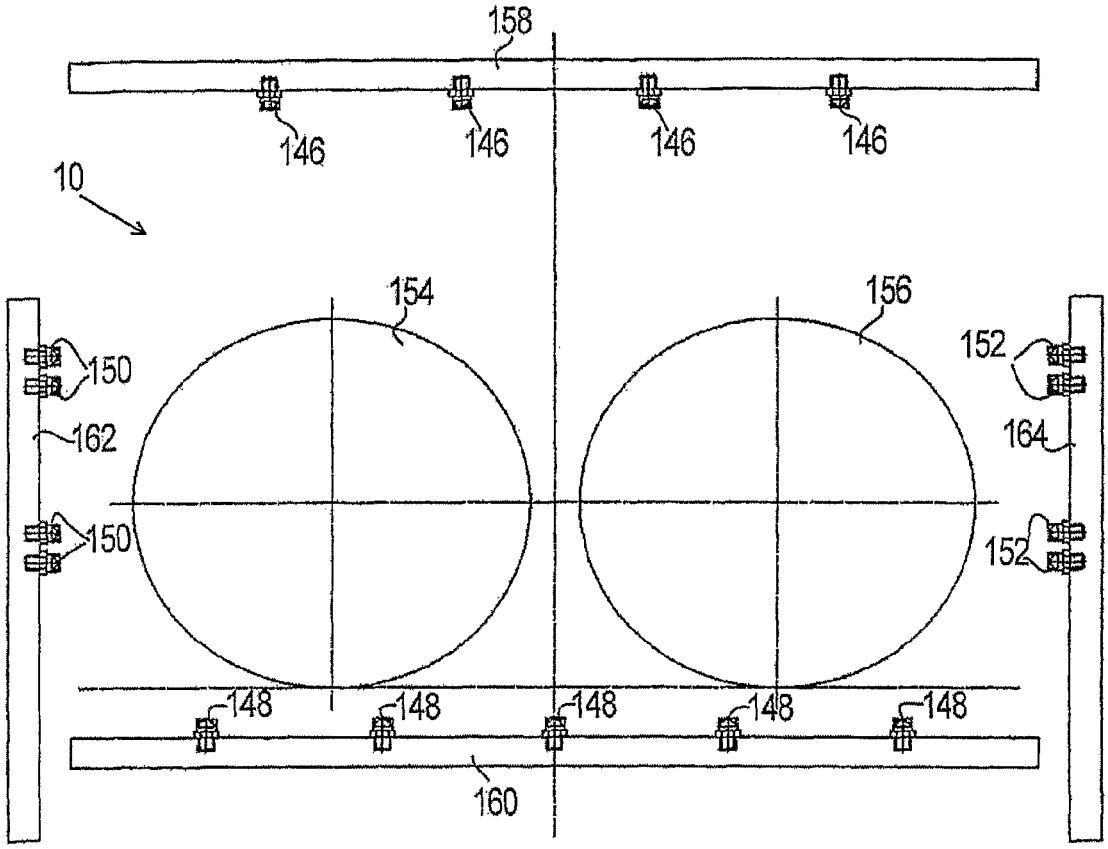
FIG. 6 is a schematic front view of a final-rinse zone of a conveyor-type dishwasher according to FIG. 1.

The final rinsing in the final spray zone 10 is carried out with a final-rinse liquid that may include a rinse agent/aid that can be fed directly from the water supply line from a container 42 (heated or unheated) by means of a pump 44 (or by mains water line pressure) to upper and lower final-rinse nozzles, in particular to upper final-rinse nozzles 46 and lower final-rinse nozzles 48, which may be formed as simple openings. Also arranged on the side walls of the final-rinse zone are lateral final-rinse nozzles 50, with which lateral spraying of the items to be cleaned with final-rinse solution can be carried out. As shown, the lateral final-rinse nozzles 50 may be located upstream of the lower and upper final-rinse nozzles. Where spray jets from the lateral nozzles are angled with or against the conveying direction 12, such offsetting may aid in limiting or preventing the spray jets of final-rinse liquid from spraying out of the final-rinse zone (e.g., into the dryer zone) and/or out of the machine entirely. An arrangement of the final-rinse nozzles provided by way of example is shown in FIG. 6.

Furthermore, spray curtains 51 may be provided in the entry and exit regions of the series of the spray zones and between the individual spray zones 4, 6, 8, 10 achieving a subdivision of the different spray zones 4, 6, 8, 10 and a reduction in the transfer of vapours between the individual spray zones. The spray curtains 51 may be designed for example in form of suspended, 10-15 cm wide sheets, which screen off the passages between the individual spray zones.

A blower 54 in the upper part of the conveyor-type dishwasher 2 sucks vapours upwards in the direction of an outlet 52, said vapours being passed through a heat exchanger 56 before they reach the extractor 52. Cold tap water is introduced via a corresponding supply line 57 into the heat exchanger 56, in which it is passed in a known way through cooling coils 58, in order to bring about a condensation of the moisture from the vapours which are flowing around the cooling coils. The transferred heat and the heat of condensation of the vapours is used for pre-heating the tap water. Such a heat exchanger for conveyor-type dishwashers is described for example in U.S. Pat. No. 3,598,131.

The tap water preheated in the heat exchanger 56 is passed via a system of lines 60, 62 and a buffer storage container 64 into the final-rinse container 42. Furthermore, a rinse aid/agent is added to the clean water to form the final rinsing aid solution. Accordingly, a clean final-rinse liquid or solution, formed from clean water and rinse aid, is used in the final-rinse zone 10. Once it has been used in the final-rinse zone 10, the final-rinse solution is guided into the heatable hot post-wash zone 8. Some or all of the hot solution used in the hot post-wash zone 8 is guided via baffles 66 into the heatable main wash reservoir 28. A dishwashing detergent is added to the solution in the main wash reservoir 28 to form a dishwashing detergent solution. A first part of the dishwashing detergent solution used in the main wash zone 6 is returned to the main wash reservoir 28, which may be assisted by baffles 68, and a second part is passed via the overflow line 70 into the pre-wash reservoir 20.

The pre-wash reservoir 20, the main wash reservoir 28, the hot post-wash reservoir 34 and the final-rinse container 42 are designed either as upwardly open reservoirs or else as tanks with an opening or a supply line, through which a solution already used in one of the spray zones 4, 6, 8, 10 or else clean water can be fed into the reservoir, the container or the tank. Respective liquids in reservoirs 20, 28 and 34 will typically be recirculated. Furthermore, the four reservoirs, containers or tanks 20, 28, 34, 42 respectively have a discharge line, through which solution can be fed, for example to the associated nozzles.

Furthermore, a bypass supply line 72 is provided from the hot post-wash reservoir 34 into the pre-wash reservoir 20, allowing hot solution to be fed from the hot post-wash reservoir 34 directly into the pre-wash reservoir 20 by means of the pump 36 when a valve 74, which may be designed for example as a solenoid valve, is opened. This may be required in particular when the conveyor-type dishwasher 2 is started for the first time, or if great contamination of the dishwashing detergent solution in the pre-wash reservoir 20 is detected, and consequently regeneration of the dishwashing detergent solution is required.

The main wash reservoir 28 can also be filled with clean water, preferably with warm clean water, directly via a main cleaning supply line 76 by opening a valve 78, which is preferably designed as a solenoid valve. Such filling via the main cleaning supply line 76 may likewise be required when the conveyor-type dishwasher 2 is started for the first time, or else if great contamination of the dishwashing detergent solution in the main cleaning reservoir 28 is detected, and consequently regeneration of the dishwashing detergent solution in the main wash reservoir 28 is required.

The temperature of the final-rinse liquid in the final-rinse zone 10 may be reduced considerably in comparison with the temperature of the hot solution in the hot post-wash zone 8. Accordingly, no heating is generally necessary in the final-rinse container 42, but a heating apparatus may be provided, as is shown by a way of example in FIG. 2 (item 43).

The items to be cleaned leave the final-rinse zone 10 in a still hot state, so that drying with unheated circulating air is sufficient in the drying zone 14. Accordingly, heating is not required for the final-rinse zone 10 or for the drying zone 14; in alternative configuration, however, the drying zone and the final-rinse zone may also be heated.

The temperature in the hot post-wash reservoir 34 may be set by a heating apparatus between 70° C. and 90° C., preferably at 85° C. The temperature of the final-rinse aid solution in the final-rinse container 42 lies within a relatively large range, since it depends on whether the clean incoming water used is warm or cold, whether the clean water is passed through the heat exchanger 56 before it is introduced into the final-rinse container 42 and furthermore, whether a heating apparatus is provided in the final-rinse container 42. The lower limit of the temperature range for the final-rinse aid solution in the final-rinse container 42 is that of unheated tap water and the upper limit may be 65° C. or preferably 60° C.

The temperature of the dishwashing detergent solution in the heatable main wash reservoir 28 may be about 65° C. or higher. The relatively high temperature allows the flow rate and the pressure with which the dishwashing detergent solution is sprayed onto the items to be cleaned to be kept comparatively low, without causing any deterioration of the dishwashing result.

Since comparatively little clean water is fed into the washing circuit in the case of the conveyor-type dishwasher 2 shown, there is consequently also a reduction in the amount of dishwashing detergent solution that is fed from the main wash zone 6 into the pre-wash reservoir 20 via the overflow line 70. The pre-wash reservoir 20 is not heatable, and, on account of the reduced feeding of dishwashing detergent solution of a higher temperature from the main wash zone 6, a temperature which is considerably lower than the temperature in the main wash reservoir 28 occurs in the pre-wash reservoir 20. It lies between 35° C. and 55° C., preferably between 40° C. and 50° C.

A similar effect as in the final-rinse zone 10 is achieved in the pre-wash zone 4, that is to say that the reduced temperature in comparison with the main wash zone 6 has the effect that vapours which enter the pre-wash zone 4 from the main wash zone 6 are condensed, and consequently the heat of condensation remains within the conveyor-type dishwasher 2 and the escape of vapours into the outside area is suppressed.

In FIG. 2 to 5, embodiments of the invention which respectively have features that can optionally be realized in addition to the basic embodiment of FIG. 1 are represented by way of example. In this case, not only can each embodiment of FIG. 2 to 5 be combined individually with the basic embodiment from FIG. 1, but also a number of them together can be combined with it. In the description which follows of FIG. 2 to 5, only the different or additional features are discussed; for identical features, reference is made to the detailed description of FIG. 1.

Figure 2:
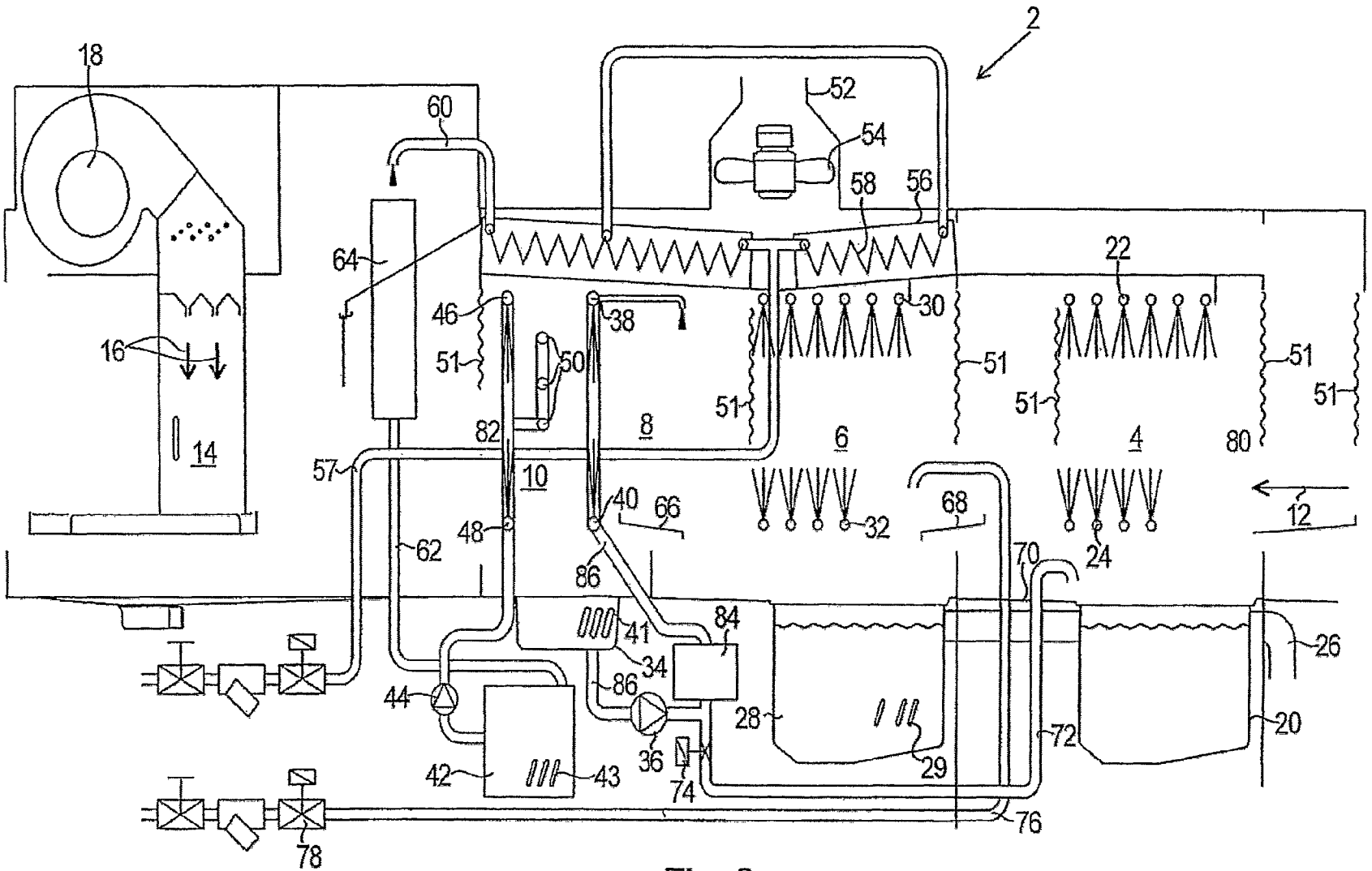
FIG. 2 is a schematic longitudinal sectional representation of a conveyor-type dishwasher according to a second embodiment of the invention.

According to the embodiment shown in FIG. 2, a filter 84 via which the hot post-wash nozzles 38, 40 can be supplied with the hot solution is arranged in a supply line 86. Hot solution is therefore fed from the hot post-wash reservoir 34 through the pump 36, through the filter 84 and subsequently to the hot post-wash nozzles 38, 40.

The filter 84 allows the hot post-wash operation to be carried out with a relatively clean hot solution, also with the result that relatively clean water is passed on to the preceding wash zones 6, 4 and counteracts a contamination of the dishwashing detergent solution there. A particularly suitable filter is designed for the purpose of filtering out particles of more than 300 μm, preferably more than 150 μm; a configuration with a still smaller pore width may be advisable.

Figure 3:
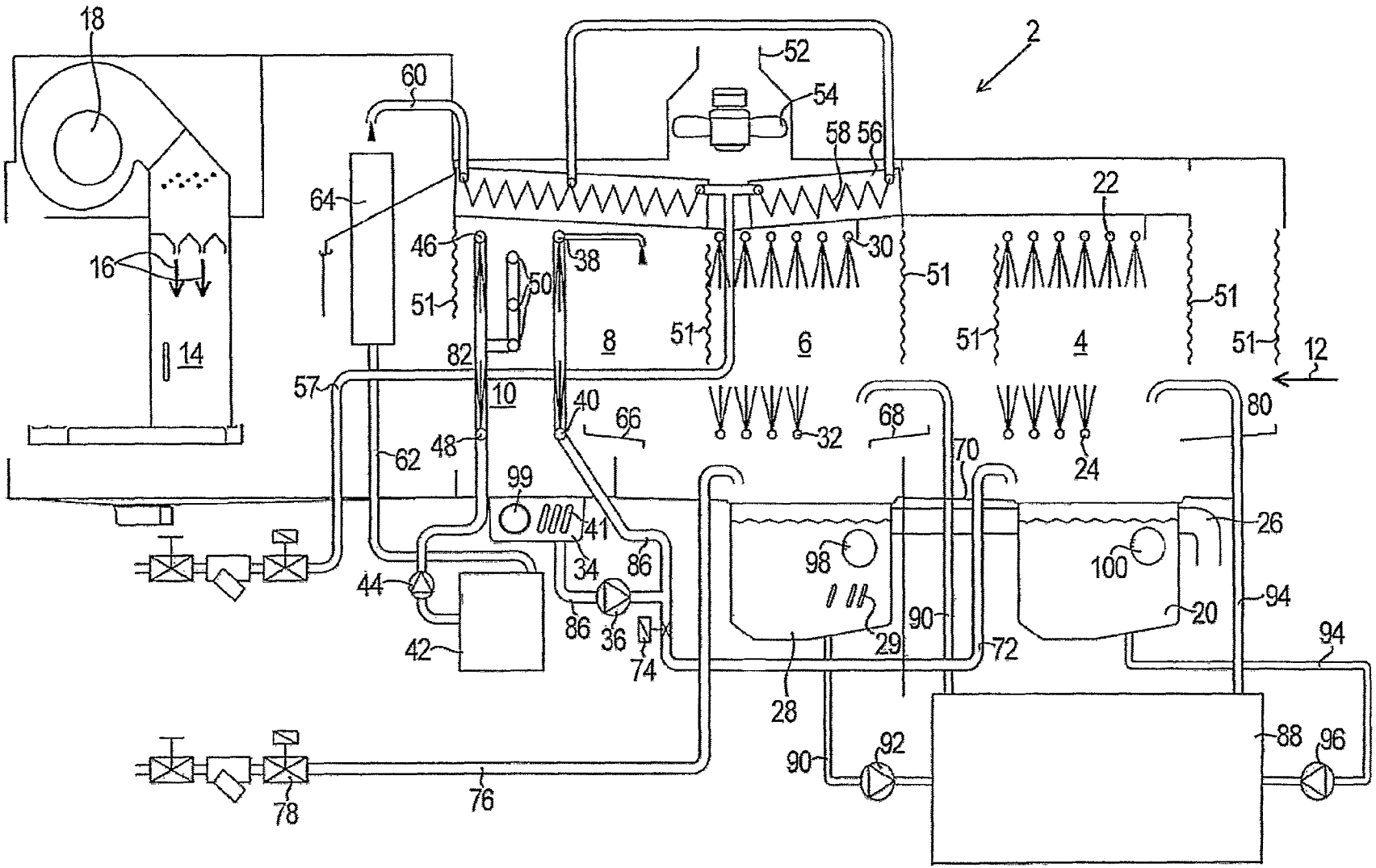
FIG. 3 is a schematic longitudinal sectional representation of a conveyor-type dishwasher according to a third embodiment of the invention.

FIG. 3 shows a filter arrangement 88, through which dishwashing detergent solution from the main wash reservoir 28 and dishwashing detergent solution from the pre-wash reservoir 20 can be filtered. Via a first bypass line 90, dishwashing detergent solution from the main wash reservoir 28 is fed by means of a pump 92 through the filter arrangement 88 and back into the main wash reservoir 28. Via a second bypass line 94, dishwashing detergent solution from the pre wash reservoir 20 is fed by means of a pump 96 through the filter arrangement 88 and back into the pre-wash reservoir 20. In the filter arrangement 88, there are either separate filters for the dishwashing detergent solution from the main wash reservoir 28 and for the dishwashing detergent solution from the pre-wash reservoir 20 or only one common filter.

In alternatives to the configuration shown here, a filter may either be provided only in or at the pre-wash reservoir or only in or at the main wash reservoir or only in or at the hot post-wash zone. The filter solutions mentioned serve to get a reduction of the extremely small particles (so-called specks) before the items to be cleaned run through the clean-water final-rinse zone. Such extremely small particles may be entrained by a dishwashing detergent solution or by a rinse solution, which is contaminated (even if only slightly), onto the surfaces of the items to be cleaned. The use of filtered rinse solution in the hot post-wash operation described above allows a significant increase in its efficiency, which depends on the contamination of the wash tank(s) and the transfer of dirt from the wash tank/wash tanks into the pre-wash tank.

In preferred configurations, the filter or filters are designed as cyclone, membrane or piggyback filters, of a structural type of design that is essentially known.

Furthermore, a turbidity sensor 98 is provided in the main wash reservoir 28, a turbidity sensor 99 is provide in the hot post-wash reservoir 34 and a turbidity sensor 100 is provided in the pre-wash reservoir 20, allowing the cleanness of the dishwashing detergent solution to be checked. The amount of dishwashing detergent solution that is fed through the bypass lines 90, 94 is controlled in dependence on the signal of the turbidity sensors 98, 100. (Configurations with only one turbidity sensor are also possible).

Figure 4:
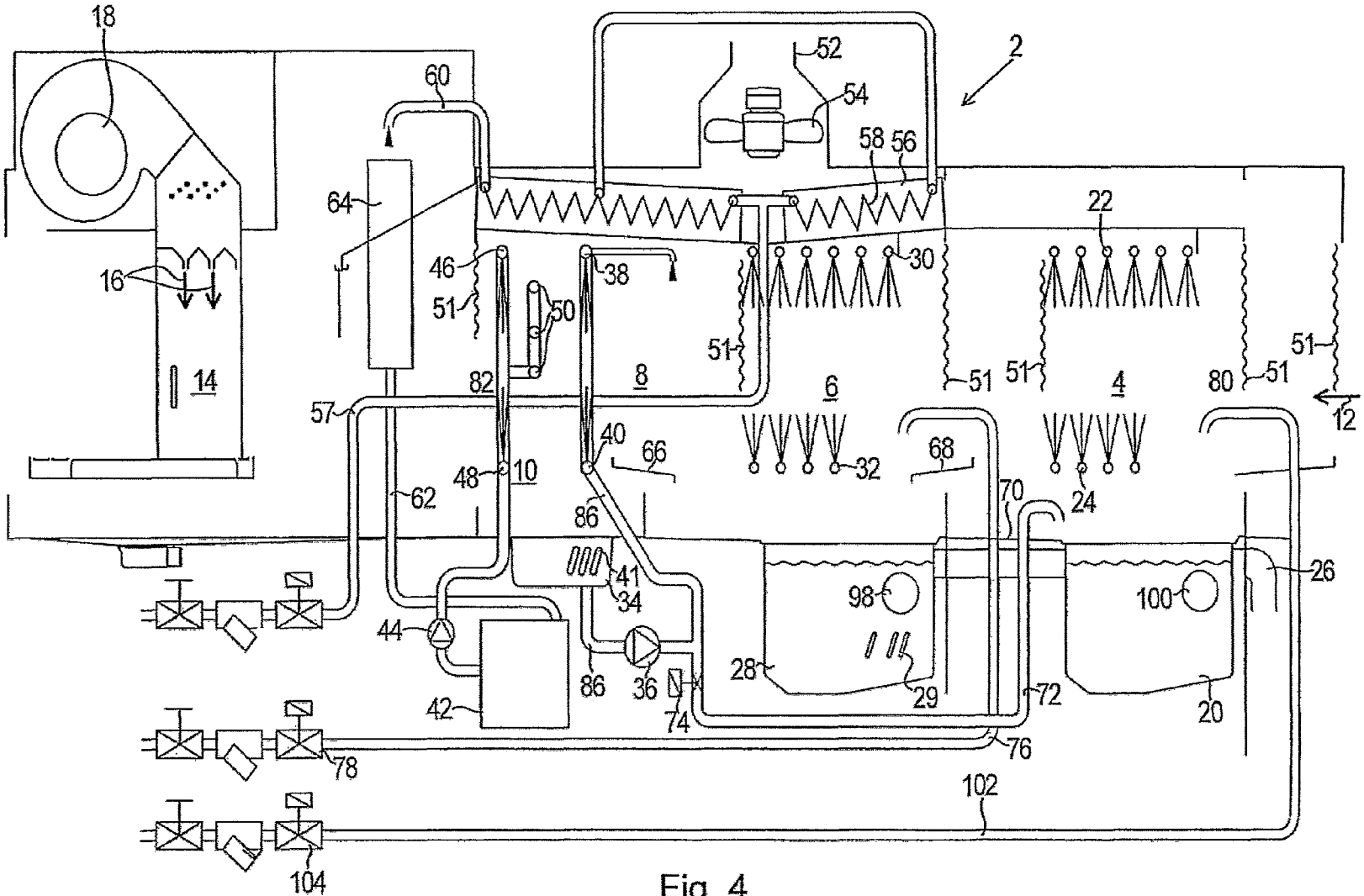
FIG. 4 is a schematic longitudinal sectional representation of a conveyor-type dishwasher according to a fourth embodiment of the invention.

Also in FIG. 4, a turbidity sensor 98 is provided in the main wash reservoir 28 and a turbidity sensor 100 is provided in the pre-wash reservoir 20, allowing the cleanness of the dishwashing detergent solution to be checked in a way similar to in the case of the turbidity sensors 98, 100 shown in FIG. 3. If excessive contamination of the dishwashing detergent solution in the main wash reservoir 28 is established by the turbidity sensor 98, a regeneration of the dishwashing detergent solution is carried out, in that clean water is fed in via the main cleaning supply line 76 by opening the valve 78. In an analogous way, a pre-cleaning supply line 102 is also provided for the pre-wash reservoir 20, allowing clean water to be fed into the pre-wash reservoir 20 by opening a valve 104. Feeding clean water into the pre-wash reservoir 20 is started if excessive contamination of the dishwashing detergent solution in the pre-wash reservoir 20 is established by the turbidity sensor 100. Details of the signal processing are presented further below.

Figure 5:
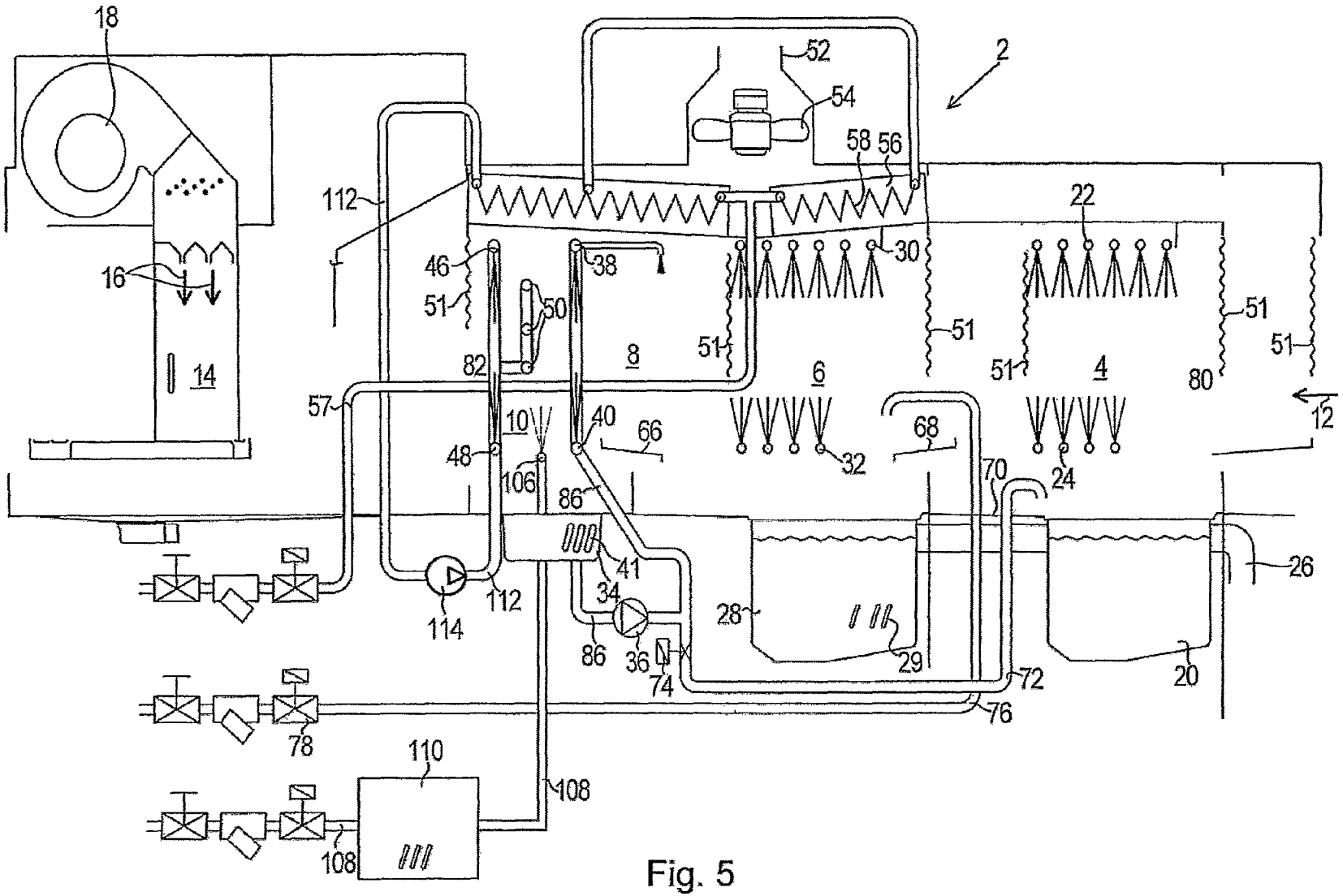
FIG. 5 is a schematic longitudinal sectional representation of a conveyor-type dishwasher according to a fifth embodiment of the invention.

According to the embodiment which is shown in FIG. 5, a nozzle or opening 106 is provided, allowing steam to be introduced in the region between the hot post-wash zone 8 and the final-rinse zone 10. Via a steam supply line 108, water is fed to a boiler 110, in which the water is heated to about 100° C., so that in the downstream section of the steam supply line 108 there is steam, i.e. water vapour at about 100° C., which is passed on to the nozzle 106. A machine could also be provided with a suitable input point/connector for connecting to an external source of clean steam that might be available at the site of machine installation/use.

FIG. 6 shows an arrangement of the final-rinse nozzles in the final-rinse zone 10. Four upper (or top-located) final-rinse nozzles 146 are arranged in an upper part of the final-rinse zone 10, their spraying direction being directed essentially downwards. Furthermore, five lower (or bottom-located) final-rinse nozzles 148 are provided in a lower part of the final-rinse zone 10, the spraying direction of which is directed essentially upwards. The lateral (or side-located) final-rinse nozzles 150, 152 are arranged within a section of the height in which or in the vicinity of which items to be cleaned are conveyed through the final-rinse zone 10, so that the side-originating spray jets of the lateral final-rinse nozzles 150, 152 are directed laterally onto the items to be cleaned. Of the lateral rinsing nozzles 150, 152, two are respectively close to each other. The items to be cleaned are schematically represented in FIG. 6 by two plates 154, 156, which are held in a corresponding carrier. Both left-hand final-rinse nozzles 150 and right-hand final-rinse nozzles 152 may be provided.

The upper final-rinse nozzles 146 are arranged in a row on an upper supply pipe 158 and the lower final-rinse nozzles 148 are arranged in a row on a lower supply pipe 160, via which they are supplied with final-rinse solution, the upper supply pipe and lower supply pipe running essentially horizontally and transversely to the conveying direction 12. The lateral final-rinse nozzles 150, 152 are also correspondingly arranged in a row on a left hand supply pipe 162 or a right-hand supply pipe 164, respectively, via which they are supplied with final-rinse solution, the left-hand supply pipe 162 and the right-hand supply pipe 164 extending essentially vertically and transversely to the conveying direction 12.

While in FIG. 6 the individual final-rinse nozzles 146, 148, 150, 152 are shown to be directed vertically or horizontally and transversally to the conveying direction 12, according to an advantageous embodiment at least some of the final-rinse nozzles are preferably angled slightly in or counter to the conveying direction 12 and/or are turned slightly out of the vertical or horizontal alignment.

Figure 7:
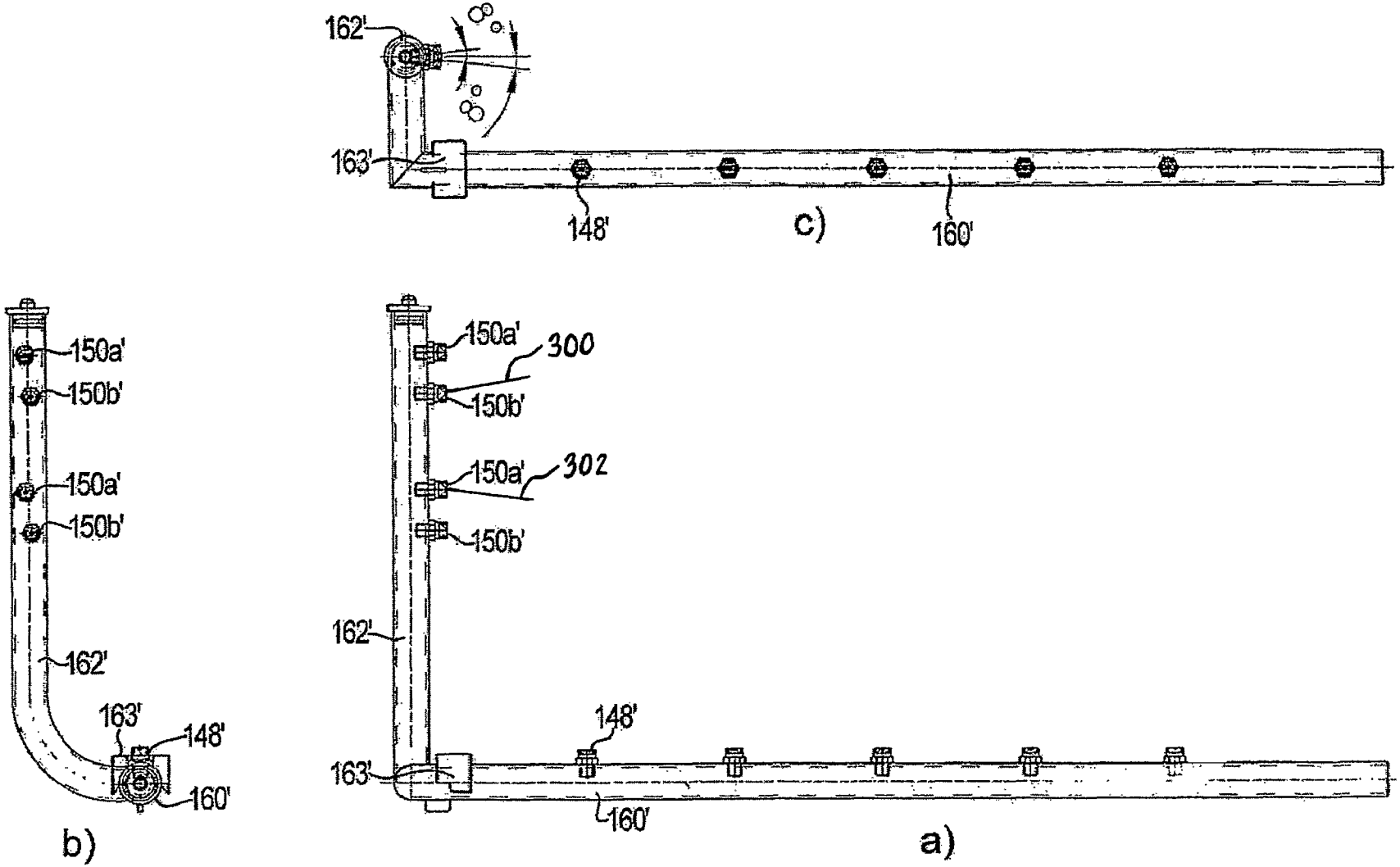
FIG. 7 is an arrangement of final-rinse nozzles modified in comparison with FIG. 6, wherein the centre part a) shows a front view, the left side part b) shows a side view, and the upper part c) shows a top view of the arrangement of the final-rinse nozzles.

A correspondingly modified configuration of the final-rinse nozzle arrangement is represented in FIG. 7. The reference numerals used there are based in those in FIG. 6. The main difference is that a supply pipe 162' shown on the left side, which is connected to the lower supply pipe 160' via an intermediate piece 163', has lateral final-rinse nozzles 150*a*', 150*b*' with different spraying directions. This different alignment can be seen in the side view of the lateral supply pipe 162' in the left-hand part of the figure and, in addition, an angle of 8° is indicated in the plan view in the upper part of the Figure, which is the angle by which the spraying direction of the nozzles 150*a*' and 150*b*' respectively is angled clockwise or anticlockwise respectively with respect to the longitudinal extent of the lower supply pipe (and the transverse direction of the machine). This achieves an improved distribution of the final-rinse aid solution over the surfaces of the items to be cleaned, which contributes to reducing the throughput of final-rinse aid solution. In view a) of FIG. 7 the movement direction of the dish carrier is into or out of the page, while in view c) of FIG. 7 the movement direction is up or down relative to such view.

In addition or as an alternative, it may be provided that the lateral final-rinse nozzles 150, 152 are alternately turned upwards and downwards out of the horizontal alignment and that the upper and lower final-rinse nozzles 146, 148 are alternately turned to the left and to the right out of the vertical alignment. For example, upper lateral nozzle 150*b*' could be oriented to direct its spray jet upward from horizontal as reflected by line 300 and lower lateral nozzle 150*a*' could be oriented to direct its spray jet downward from horizontal as reflected by line 302.

The direction of a spray jet emanating from a nozzle is generally determined by a central axis of the spray jet that is output by the nozzle, regardless of whether the spray jet is in the form of a fane, cone, stream or other configuration.

Nozzles with relatively low throughput, for example with a respective throughput of 0.16 l/min at 0.5 bar, may be used as final-rinse nozzles 146, 148, 150, 152. Tests showed that, in the case of the arrangements shown in FIGS. 6 and 7, the total clean water consumption was 2.5 l/min when nozzles with a throughput of 0.15 l/min at 0.5 bar were used. Consequently, the total clean water consumption lies considerably below the value of 3.7 l/min which is customary in the prior art.

The final-rinse nozzles of the final-rinse zone are advantageously designed in such a way that they produce an atomization of the solution into finely distributed droplets, whereby full-coverage rinsing of the items to be cleaned can be achieved with a low delivery rate of solution. In particular in the final-rinse zone, a fine atomization of the rinsing aid solution is also advantageous because the finely distributed droplets promote condensing of the vapours. By providing the lateral nozzles in addition to the typical upper and lower nozzles, a more effective distribution of final-rinse liquid onto items to be cleaned can be obtained, facilitating a reduction in total consumption of final-rinse liquid.

The invention is not restricted to the embodiments shown by way of example in FIG. 1 to 6 and the method steps described with respect to them. Rather, the invention is to be understood by overall consideration by a person skilled in the art of the claims, the description, the embodiments that are provided by way of example and the variants mentioned below, which are intended to give a person skilled in the art suggestions for further alternative embodiments.

The conveyor-type dishwasher shown in FIG. 1 to 5 may be designed in various ways, in particular various conveying mechanisms by means of which items to be cleaned are conveyed through the machine can be realized.

A carrier for accommodating items to be cleaned, in particular dishes, may be designed for example as a dish conveying belt in the form of an endless belt, which has a suitable structure, so that is can be loaded with individual items to be cleaned and the individual items can then be held in the most optimum possible rinsing position, in which the largest possible surface of the individual items is reached by the dishwashing detergent solution and the final-rinse aid solution. The conveyor-type dishwasher may accordingly be designed as a conveyor-belt dishwasher, in which items to be cleaned are automatically conveyed on the dish conveying belt through the various rinse zone and through a downstream drying zone.

Furthermore, the conveyor-type dishwasher may also be designed as a rack-conveying dishwasher. In the case of such an embodiment, dish racks are provided which can be loaded with individual items to be cleaned and in which the individual items to be cleaned can be held in the most optimum possible rinse position. Furthermore, a rack-conveying dishwasher has conveying means for conveying the dish racks through the various spray zones 4, 6, 8, 10 and the drying zone 14. Chains, latching bars or conveyor belts are known types of conveying means.

The conveyor-type dishwasher shown may also be designed as a multi-track dishwasher with a number of parallel-running conveying tracks. In the case of dishwashers of a small overall size and low dishwashing capacity, the pushing through of dishes, which are for example sorted into appropriate dish racks, may also take place manually.

Furthermore, the number and design of the spray zones is not restricted to the four spray zones 4, 6, 8, 10 that are shown, but may be adapted to the corresponding conditions. A drying zone 14 after the final-rinse zone 10 is not absolutely necessary.

As described in detail in the foregoing part, the escape of vapours from the machine is reduced and condensation within the machine is promoted by the lower temperature of the solution in the final rinse zone 10 and in the pre-wash zone 4 in comparison with the temperature in the main wash zone 6 and the hot post-wash zone 8. This effect may be further increased at the outer regions of the series of spray zones 4, 6, 8, 10 by a cold water curtain being created at the entry region 80 of the pre-wash zone 4 and/or at the exit region 82 of the final-rinse zone 10.

The cold water curtain may be formed for example by suitable nozzles or openings which can be supplied with cold water and which are arranged over the width of the entry region 80 and/or the exit region 82 of the conveyor-type dishwasher 2, or by an edge extending over this width and over which cold water can flow.

Figure 8:
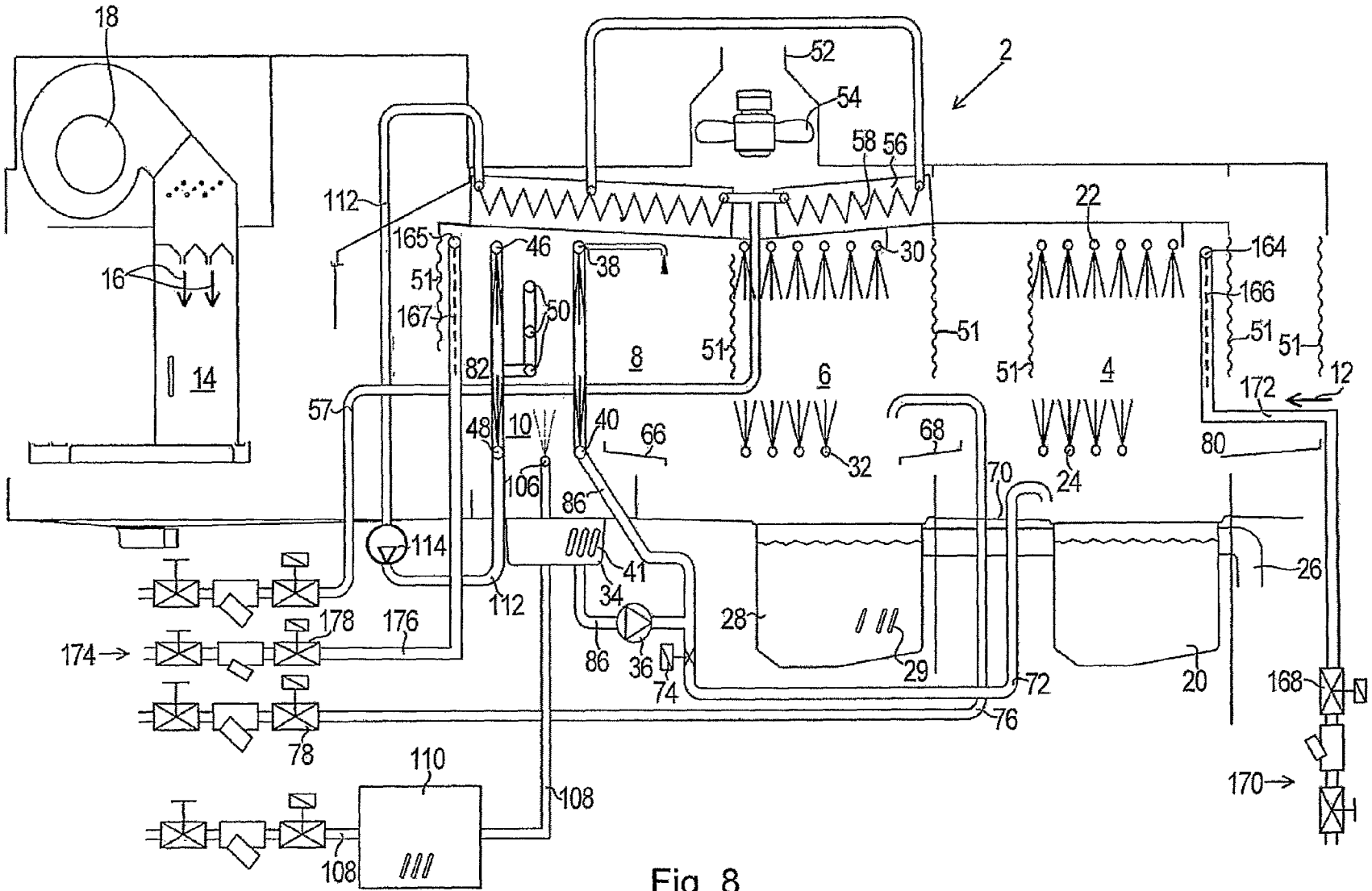
FIG. 8 is a schematic longitudinal sectional representation of a conveyor-type dishwasher according to a sixth embodiment of the invention.

Shown in FIG. 8 is a conveyor-type dishwasher in which nozzles 164 are arranged in the entry region 80 and nozzles 165 are arranged in the exit region 82 for creating a cold water curtain 166, 167. The nozzles 164, 165 are respectively distributed over the width of the conveyor-type dishwasher in such a way that the cold water curtain 166 of the entry region 80 and the cold water curtain 167 of the exit region 82 extend over the entire entry opening or exit opening respectively, and consequently an escape of vapours is effectively prevented.

To create a cold water curtain 166 in the entry region 80, the nozzles 164 can be supplied with cold water via a corresponding supply line 172 by opening a valve 168 of a cold water connection 170. A cold water connection 174 and a supply line 176 are also provided for nozzles 165 for the cold water curtain 167 in the exit region 82, so that cold water can be fed to the nozzles 165 by opening a valve 178.

A filter, as is shown in FIG. 2, may be arranged at various positions of the supply path from the hot post-wash reservoir 34 to the hot post-wash nozzles 38, 40. In a similar way, a filter may also be provided in the supply line to the main wash nozzles 30, 32 and/or in the supply line to the pre-wash nozzles 22, 24. While large dirt particles are generally removed from the respective solution by a screen, the filter serves the purpose of removing smaller particles from the solution. While in the hot post-wash zone 8 a filter is preferably designed for filtering out particles which are 150 μm or even smaller, a comparatively coarser filter is advantageous for the pre-wash zone and the main wash zone.

A filter arrangement such as that shown in FIG. 3 may also be provided at the hot post-wash reservoir 34. In a corresponding way, bypass lines would have to be connected to the hot post wash reservoir 34, allowing solution to be fed by means of a pump out of the reservoir 34 through a filter and back into the reservoir 34. Furthermore, a controlled, selective execution of the filtering in dependence on the signal of a turbidity sensor which is filtered within the hot post-wash reservoir can be advantageous.

For the hot post-wash reservoir 34, a regenerating arrangement may be designed in a way similar to the arrangement shown in FIG. 4 for the pre-wash reservoir 20 and the main wash reservoir 28, allowing feeding into the hot post-wash reservoir 34 in dependence on the turbidity of the solution in this reservoir.

In FIG. 5, the supply of steam is shown by way of example between the hot post-wash zone 8 and the final-rinse zone 10. This position or else a positioning of the nozzle 106 in the hot post-wash zone 8 is advantageous, since the level of heat transferred into the items to be cleaned and accordingly disinfection of the items to be cleaned is assisted by the steam which is introduced. Similarly, the drying behaviour of the items to be cleaned is improved by the increased level of heat which was transferred.

The arrangement of the final-rinse nozzles, by means of which the items to be cleaned are subjected to a solution from at least three sides, is not restricted to the embodiment shown in FIG. 6; in particular, there are several advantageous embodiments with respect to the number and positioning of the individual final-rinse nozzles 146, 148, 150, 152.

Slight offsetting of the individual final-rinse nozzles 146, 148, 150, 152 in relation to one another in or transversely to the conveying direction 12 may also be provided. This may be realized by correspondingly shaped supply pipes 158, 160, 162, 164 and/or by additional supply lines to the individual final-rinse nozzles 146, 148, 150, 152.

Figure 9:
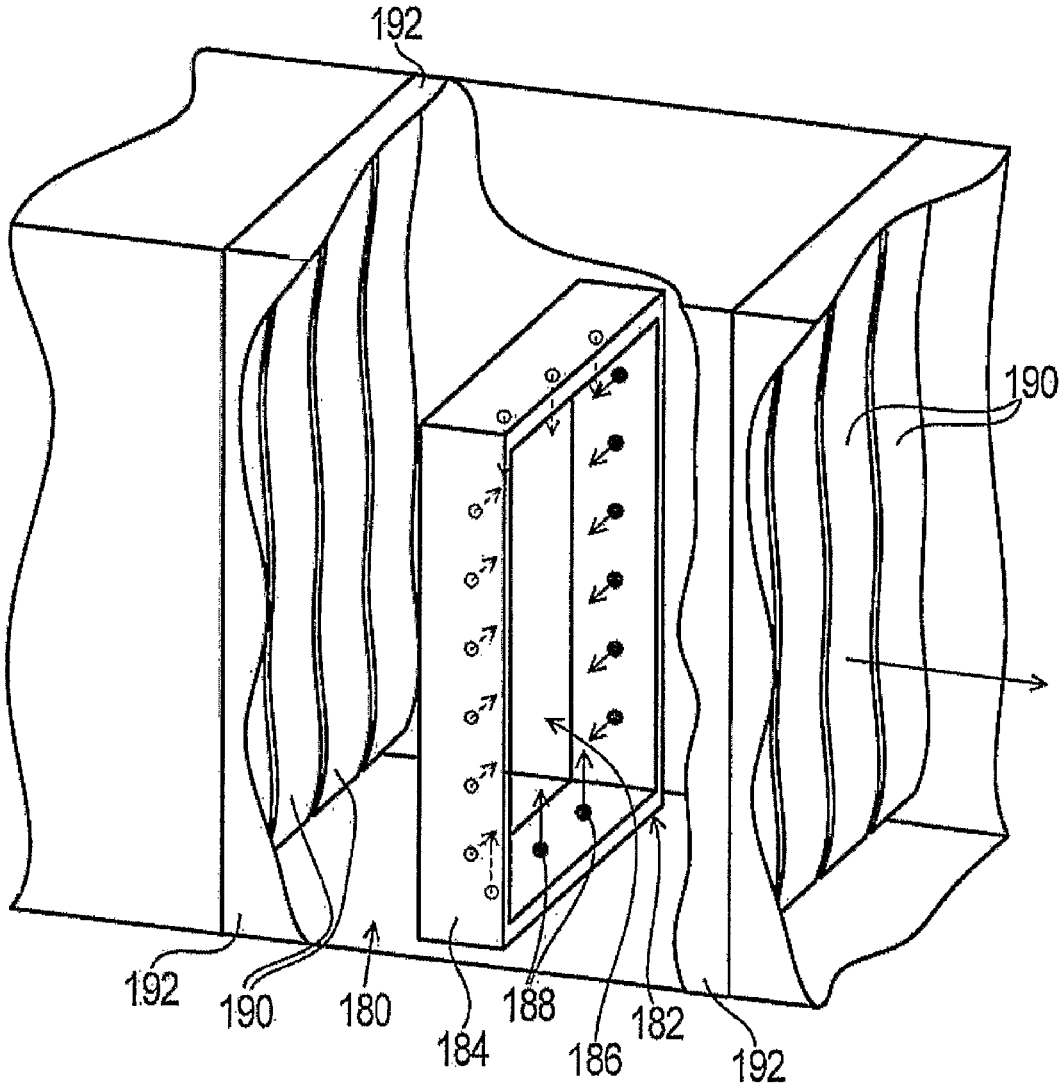
FIG. 9 is a schematic perspective representation of a zone for subjecting the items to be cleaned to the action of steam in a conveyor-type dishwasher of a seventh embodiment.

In FIG. 9, part of a modified embodiment of a conveyor-type dishwasher according to the invention is schematically shown. In the case of this embodiment, a steam-subjecting zone 180 is provided, in which items to be cleaned are subjected to the action of steam. The housing of the conveyor-type dishwasher is shown in a broken-open representation in the region of the steam-subjecting zone 180, so that it is possible to see into its interior space. Steam is introduced into the steam-subjecting zone 180.

The steam-subjecting zone 180 is arranged downstream of a hot post-wash zone and upstream of a final-rinse zone in the conveying direction of the items to be cleaned that is denoted by an arrow. A nozzle surround 182 is provided in the steam-subjecting zone 180. The nozzle surround 182 has a frame 184 with a through-opening 186, through which the items to be cleaned can be sent. On the inside of the frame 184, a multiplicity of inwardly directed steam nozzles 188 are arranged on all the peripheral sides. Arranged in the frame is a system of lines (not shown), which is in connection with a supply line via which steam is fed to the steam nozzles 188. Accordingly, steam is directed onto the items to be cleaned from all peripheral sides, so that largely the entire surface of the items to be cleaned is effectively subjected to steam.

In order to suppress the escape of steam into the neighbouring rinse zones, curtains 190, which are designed as an arrangement of suspended sheets, are respectively fitted between these zones and the steam-subjecting zone 180. The housing wall 192 of the steam-subjecting zone 180 may have an additional thermal insulation, so that the lowest possible heat losses to the outside occur. The zone 180 may be arranged such that the entire zone is filled with steam at a pressure higher than atmospheric. The curtains 190 reduce heat transfer into the neighbouring spray zones.

Figure 10:
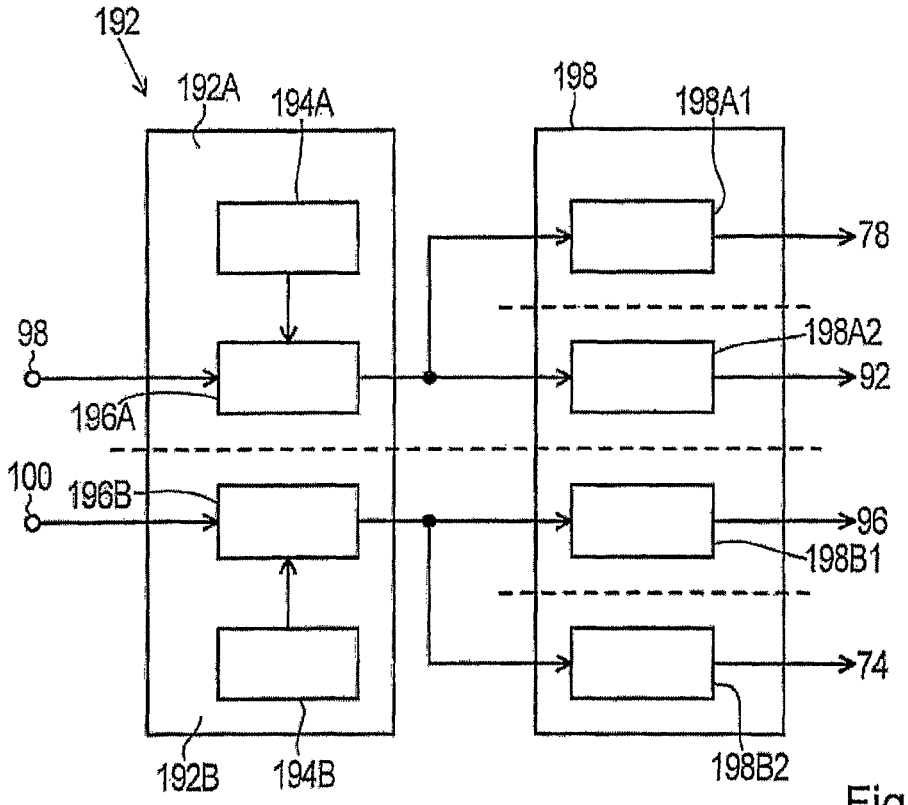
FIG. 10 is a schematic representation in the form of a functional block diagram to explain controlled filtering or regeneration of used rinse solutions.

FIG. 10 shows in a schematic representation the components used for carrying out controlled filtering and/or regeneration (clean water supply or rinse solution transfer), following on from the above description with respect to FIGS. 1 and 3.

This concerns the turbidity sensors 98 and 100 in the main wash reservoir 28 and the pre wash reservoir 20, respectively, which may be based on an optical measuring principle, known per se, and produce a signal representing the degree of contamination of the respective wash solution in the reservoirs mentioned. The turbidity sensors 98, 100 are respectively connected to an input of a two-channel turbidity evaluation unit 192. The turbidity evaluation unit 192 is essentially constructed identically in the two channels 192 A and 192 B and each comprises a threshold-value memory 194 A and 194 B, respectively, for preprogrammed turbidity threshold values for the wash reservoirs 28 and 20, respectively, and a threshold-value discriminator 196 A and 196 B, respectively, both inputs of which are connected to the respectively associated turbidity sensor 98 or 100 and the respective threshold-value memory 194 A and 194 B.

In the present example, it is assumed that the threshold-value discriminators 196 A, 196 B are of a multistage configuration and also that a number of threshold values are respectively stored in the associated threshold-value memories 194 A, 194 B. In a corresponding way, here each threshold-value discriminator emits not only a digital signal (yes/no), but a quasi-analog signal, representing the exceeding of one or more threshold values.

On the output side, the evaluation device 192 is connected to a control device 198 which has four control sections 198 A1 to 198 B2. The control section 198 A1 is designed as a valve controller for controlling the valve 78 for supplying clean water into the main wash reservoir 28. The control section 198 A2 is designed as a pump controller for controlling the pump 92 in the bypass 90 for passing wash solution from the main wash reservoir 28 through the filter arrangement 88. The control section 198 B1 is designed as a pump controller for controlling the pump 96 in the bypass 94 for passing wash solution from the pre-wash reservoir 20 through via the filter arrangement 88, and the control section 198 B2 is designed as a valve controller for controlling the valve 98 in the bypass 72 for directly passing wash solution from the hot post-wash reservoir 34 into the pre-wash reservoir 20. On account of the signal characteristics mentioned of the output signals of the threshold-value discriminators 196 A, 196 B, in each case an alternative or joint operation of the control sections 198 A1, 198 A2 and 198 B1, 198 B2, respectively, is possible, in order to control filtering and/or regeneration in dependence on the degree of contamination of the respective wash solution in an expedient way. For details in this respect, reference is made to the description provided further above.

As an alternative to use of turbidity sensors or other contamination measurement devices, the control system of FIG. 10 could include a timer block that causes production of a time-dependent control signal to effect either the filtering (e.g., via operation of a pump) or regeneration (e.g., via opening of a valve) of the particular recirculated liquid.

It goes without saying that the evaluation and control devices 192, 198 described can be constructed from commercially available hardware and software components in a way that can easily be appreciated by a person skilled in the art and according to the requirements of commercial use, and that the graphic representation and the description given here is intended only to show the essential functionality, but not to show details of the computational and logical signal processing.

Figure 11:
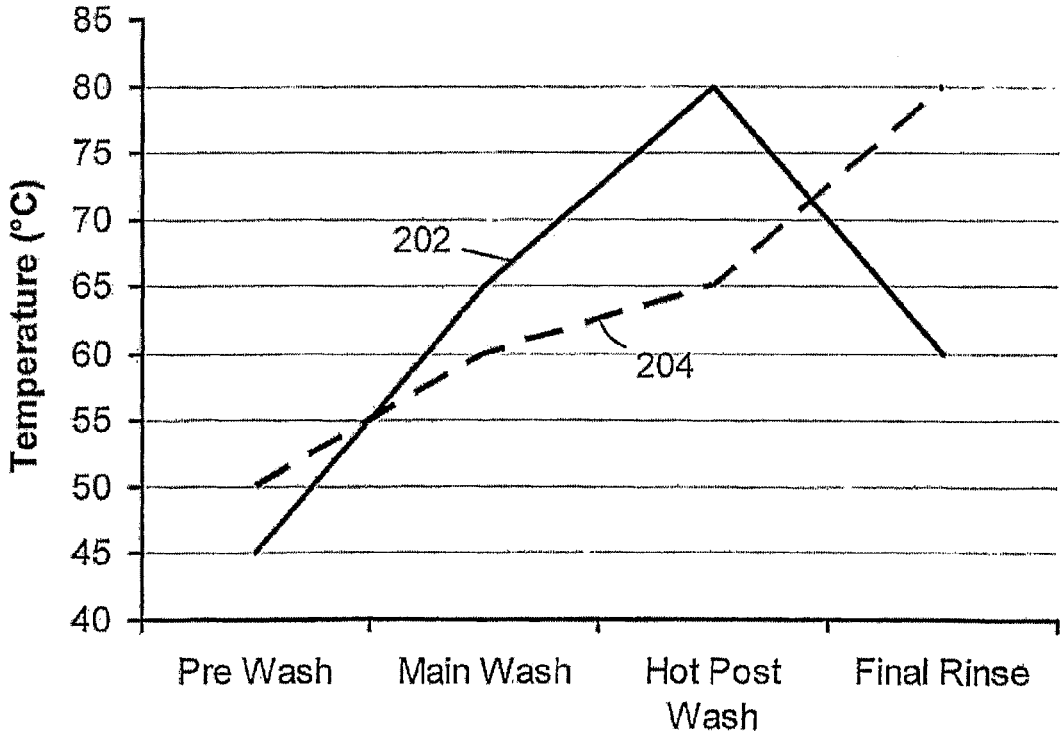
FIG. 11 is a diagram with temperature profiles.

In any embodiments of the invention, the final-rinse liquid used in the final-rinse zone 10 can be clean water or a mixture of water and rinse aid. The diagram of FIG. 11 shows an exemplary, preferred temperature profile 202 in comparison to a common temperature profile 204 of the prior art, each over a pre-wash operation, a main wash operation, a hot post-wash operation, and a final rinse operation in this sequence.

The invention claimed is:

1. A method of operating a conveyor dish washer, the method comprising moving items to be cleaned in a movement direction of a dish carrier through at least one wash zone and thereafter through at least one final-rinse zone; performing at least one wash operation during which a wash liquid is being sprayed onto the items to be cleaned in the wash zone, and a final-rinse operation during which a final-rinse liquid is being sprayed onto the items to be cleaned in the final-rinse zone; wherein during the final-rinse operation in the final-rinse zone the items to be cleaned are subjected to a plurality of final-rinse liquid spray jets from above and from below, and wherein items to be cleaned are subjected to a plurality of side-originating final-rinse liquid spray jets from at least one side during the final-rinse operation in the final-rinse zone, wherein a first side-originating final-rinse liquid spray jet is angled with the movement direction and a second side-originating final-rinse liquid spray jet is angled against the movement direction.

2. The method of claim l wherein nozzle openings for the side-originating final-rinse liquid spray jets are located upstream, relative to the movement direction, of nozzle openings for the plurality of final-rinse liquid spray jets from above and from below.

3. The method of claim 2 wherein the conveyor dishwasher includes a dryer zone adjacent and downstream of the final-rinse zone and the side-originating final-rinse liquid spray jets are directed to prevent spray into the dryer zone.

4. The method of claim 2 wherein the conveyor dishwasher includes an exit opening adjacent and downstream of the final-rinse zone and the side-originating final-rinse liquid spray jets are oriented to prevent spray through the exit opening.

5. The method of claim 1 wherein an angle between a center line of the first final-rinse liquid spray jet and a center line of the second final-rinse liquid spray jet is between 10° and 20°.

6. The method of claim 1 wherein the first and second final-rinse liquid spray jets are positioned one above the other within an item clearance height of the conveyor dish washer.

7. The method of claim 1 wherein at least one side-originating final-rinse liquid spray jet is angled upward from horizontal.

8. The method of claim 1 wherein at least one side-originating final-rinse liquid spray jet is angled downward from horizontal.

9. The method of claim 1 wherein at least one side-originating final-rinse liquid spray jet is angled upward from horizontal and at least one other side-originating final-rinse liquid spray jet is angled downward from horizontal.

10. The method of claim 1 wherein the side-originating final-rinse liquid spray jets are in the form of any one of a cone, a fan or a stream.

11. The method of claim 1 wherein the conveyor dishwasher operates with a capacity of 2500 to 5000 plates per hour and the final-rinse operation is executed with a consumption of final-rinse liquid of 3.5 1/min or less.

12. The method of claim 11 wherein the final-rinse operation is executed with the consumption of final-rinse liquid of between 2 1/min and 3 1/min.

* * * * *